United States Patent [19]

Collins

[11] Patent Number: 4,791,692

[45] Date of Patent: Dec. 20, 1988

[54] STUDS FOR ARTICLES OF FOOTWEAR

[76] Inventor: Roy S. Collins, "Inchgarth", 111 Moor Hall Drive, Four Oaks, Sutton Coldfield, West Midlands, England

[21] Appl. No.: 58,518

[22] Filed: Jun. 5, 1987

[30] Foreign Application Priority Data

Jun. 6, 1986 [GB] United Kingdom ..... 8613733

[51] Int. Cl.[4] ..... A43C 15/16

[52] U.S. Cl. ..... 12/142 P; 36/67 A; 36/67 D

[58] Field of Search ..... 36/62, 65, 67 D, 67 R, 36/67 A, 128, 134, 59 R; 12/142 R, 142 P

[56] References Cited

U.S. PATENT DOCUMENTS 3,911,600 10/1975 Dassler ..... 36/67 D
4,445,289 5/1984 Beneteau ..... 36/134

FOREIGN PATENT DOCUMENTS 2307678 8/1974 Fed. Rep. of Germany ..... 36/134
2733846 2/1979 Fed. Rep. of Germany ..... 36/67 R
3015116 10/1981 Fed. Rep. of Germany ..... 36/128
3112389 10/1982 Fed. Rep. of Germany ..... 36/134
1402135 8/1975 United Kingdom .
2098457 11/1982 United Kingdom ..... 36/134

*Primary Examiner*—James Kee Chi
*Attorney, Agent, or Firm*—Oldham & Oldham Co.

[57] ABSTRACT

A stud for a football boot is moulded in two parts. An attachment portion (1;25) moulded in a hard and inflexible material, such as an acetal resin, comprises an externally screw-threaded spigot (3;27) and a body providing a collar (7;29) a flange (5;30) and a central stiffening support. The stiffening support comprises a hub (8;37) supported by spokes (11;38) extending radially from the hub to the collar. A boss (2;26) of the stud is moulded on to the attachment portion and is of a tough but more resilient material, such as a polyurethane. The boss-forming material flows through apertures between the spokes to join up and form a ring (22) or plug (43) which causes the boss to become interlocked with the attachment portion.

5 Claims, 4 Drawing Sheets

STUDS FOR ARTICLES OF FOOTWEAR

This invention relates to studs for articles of footwear and is particularly, though not exclusively, concerned with studs for football boots and like sportswear.

From a first aspect the present invention consists in a stud for an article of footwear, which stud comprises an attachment portion and a ground-engaging boss, both the attachment portion and the boss being made as mouldings of plastics or similar materials, the attachment portion comprising an externally screw-threaded spigot, for engagement with a complementary screw-thread in a socket in or on an article of footwear, and a body presenting means for engagement by a tool for assisting in screwing the stud tightly into the socket, the boss projecting from the body in a direction opposite to that in which the spigot projects.

The attachment portion and the boss are preferably made from different materials as the functions of these components are different from each other. The attachment portion is preferably made from a material that is relatively hard and inflexible but is not brittle, while the boss is preferably made from a material that is more flexible and resilient but is none the less tough. Thus the attachment portion may be made from an acetal resin, while the boss may be made from polypropylene, nylon 6 or polyurethane.

From a second aspect the present invention consists in a method of making a stud as set out in the last preceding paragraph but one, which method comprises moulding the attachment portion and then moulding the boss on to the attachment portion.

The boss is preferably moulded onto the attachment portion so as to become permanently attached to the attachment portion. To this end the attachment portion preferably incorporates one or more apertures such that during the formation of the boss, boss-forming material can flow into or through the aperture or apertures to enable the boss to become permanently interlocked with the attachment portion. Preferably the boss-forming material forms enlarged portions at each end of the aperture, or at each end of each aperture, so that the boss-forming material becomes mechanically interlocked with the attachment portion.

In a preferred arrangement, boss-forming material flows through a plurality of apertures in the attachment portion and joins up to form a plug or ring within a recess in the attachment portion. To that end, the body of the attachment portion may comprise a central stiffening support comprising a hub which is aligned axially with the spigot, the hub being supported by means of a plurality of spokes extending radially outwards to an annular portion of the body forming a collar; in such an arrangement the boss-forming material can flow through apertures between the spokes and join up as a ring or plug beyond the spokes.

Preferably the attachment portion and the boss are made of materials of different colours. Moreover the arrangement is preferably such that, in use, when the boss is partially worn away, there is revealed part of the attachment portion within the boss constituting wear-indicating means, the appearance of that means signalling to the user that the stud should be discarded and replaced by a new one. It will be obvious that the greater is the contrast between the colours, the more readily the wear-indicating means will be seen. When the attachment portion includes a stiffening support the wear-indicating means may be constituted by an end portion of the stiffening support.

The body of the attachment portion of the stud preferably includes an outwardly directed flange for engagement with the underside of an article of footwear or with an end of a socket in an article of footwear or with both.

Two embodiments of the present invention will now be described in more detail, by way of example only, with reference to the accompanying drawings, in which.

Figure 1:
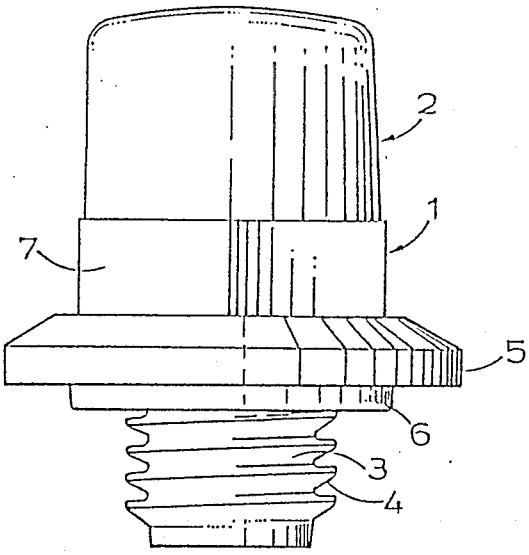
FIG. 1 is a side view of a first stud embodying the present invention.
Figure 2:
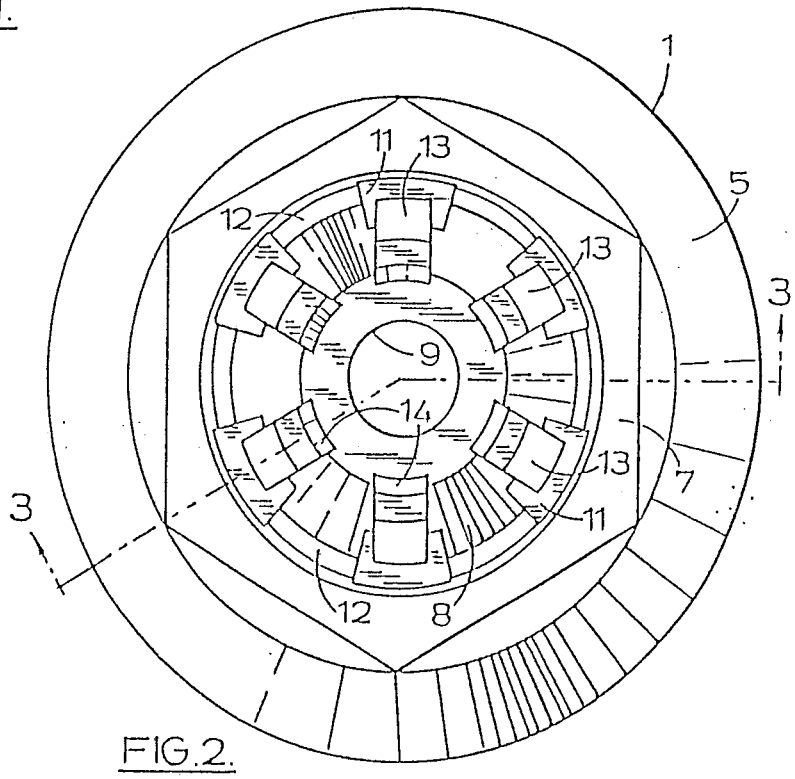
FIG. 2 is a plan view to a larger scale, of an attachment portion of the stud shown in FIG. 1.
Figure 3:
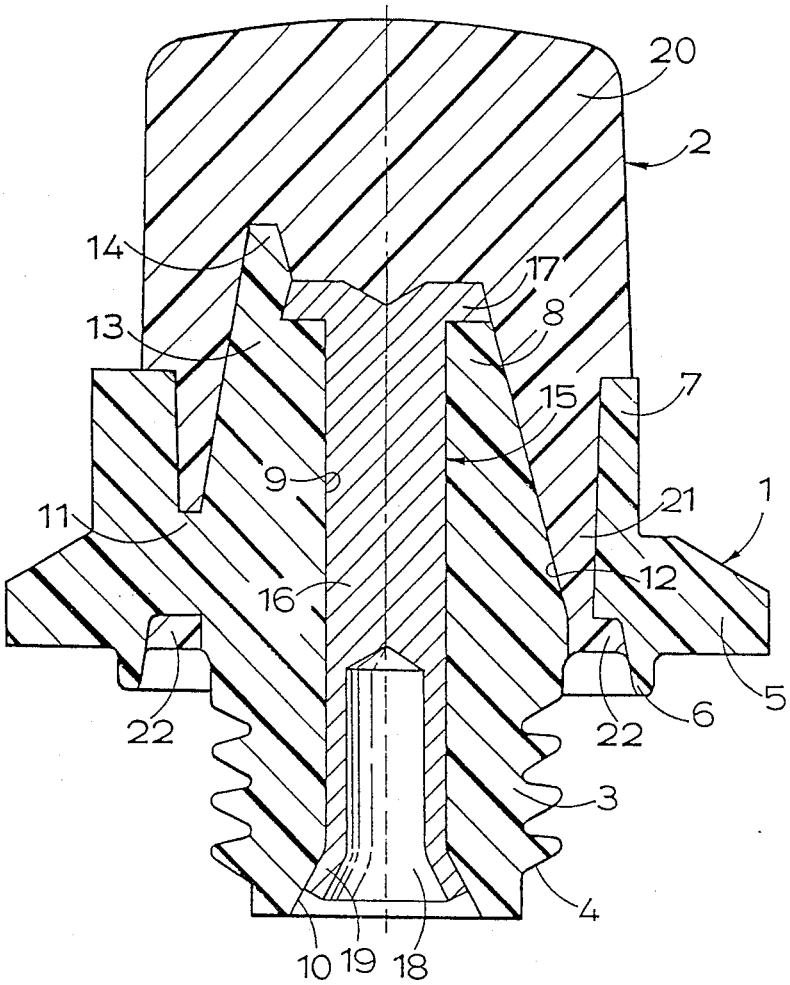
FIG. 3 is a sectional view of the stud, taken along the line 3—3 of FIG. 2.

The two studs illustrated are intended for use as football studs. With reference to FIGS. 1, 2 and 3, in the manufacture of the first stud an attachment portion 1 is initially made, and a boss 2 is subsequently moulded on to it. The attachment portion 1 is made as a moulding of a plastics material that is relatively hard, inflexible and tough; an acetal resin such as 'DELRIN' has been found to be suitable. The attachment portion includes a spigot 3 formed with an external screwthread 4 by means of which the stud can be secured in an internally threaded socket in a football boot. The form of the thread 4 is similar to that described and illustrated in the specification of the aforementioned British Pat. No. 2 115 683 and will not be further described here. The remainder of the attachment portion 1 constitutes a body. The body includes an outwardly directed annular flange 5 which in use abuts the sole of the football boot around the socket or abuts the rim of the socket, or abuts both. An annular retaining ring 6 projects from the flange 5. The purpose of the ring is similar to that of the annular retaining ring described and illustrated in the specification of British patent application No. 8518677 (Publication No. 2163037A). The ring 6 will therefore not be further described herein. The flange 5 and ring 6 are coaxial with the spigot 3.

The flange 5 extends outwards from an annular collar 7, the spigot 3 and collar 7 projecting axially in opposite directions from the flange. The inner face of the collar is of frusto-conical shape but the outer face of the collar is formed with six similar flats disposed uniformly and symmetrically around the collar. In use the flats can be engaged by a spanner or similar tool used to tighten the stud into the socket or to loosen the stud when it is to be removed from the socket. The fact that the collar 7 is formed integrally with the spigot 3 results in a direct transmission of torque from the collar to the spigot during such tightening and loosening operations, thereby avoiding the need to provide separate components that are in some manner connected together to transmit torque from one to the other—the connection between separate components for this purpose tending to be a source of complexity or difficulty in manufacture and of potential weakness.

Inside the collar 7 there is a central frusto-conical stiffening support comprising a hub 8, which is axially aligned with the spigot and projects axially beyond the collar in the direction away from the spigot. An axial hole 9 extends through the spigot and the hub 8. That end of the hole which opens through the spigot is flared, as indicated at 10, the remainder of the hole being of cylindrical shape. A broader end of the hub, adjacent to the spigot, is integrally connected to an adjacent part of the collar by a plurality of radially extending spokes 11. In the example illustrated there are six spokes, but if desired the number of spokes may be different from that. Apertures 12 extend axially through the attachment portion between the spokes. An integral buttress 13 stems from each spoke 11 and extends in a generally axial direction along the hub 8. End portions 14 of the buttresses project axially and serve as wear-indicating means. In modified constructions, the number and positions of the buttresses may be varied.

The attachment portion is made in a relatively simple mould, of which a rotatable first part defines the threaded spigot 3, a second part defines the retaining ring 6 and the adjacent faces of the flange and spokes, and a third part which defines the other faces of the flange, the collar, the hub, the apertures 12 and the spokes and buttresses. Before the attachment portion is formed, a rivet 15 is placed in the mould. The rivet has a cylindrical stem 16 with a head 17 at one end and a counterbore 18 at the other end. The rivet is located on a metal pin which enters the counterbore 18. When the mould is closed, preparatory to the introduction of the plastics material for the attachment portion, the head 17, which has a tapered edge face, engages the tapered interior of the third part of the mould. If the rivet is not in a truly axial position, it is automatically guided to such a position as the mould closes, the head 17 being centralised by the tapered interior of the third part of the mould. After the mould has been closed the pin supporting the rivet is moved axially in the direction of the head. This causes a frusto-conical shoulder on the pin to enter the counterbore 18 and to flare it outwards, as illustrated at 19. Alternatively, during the final stages of closure of the mould the third part of the mould can engage the head of the rivet and force the rivet axially onto the frusto-conical shoulder to form the flared portion 19. Whichever method is used, the rivet is in consequence firmly located in the mould. The rivet 15 may be made of any suitable material. Its prime purpose is to stiffen the stud, for it will be appreciated that in use, the spigot is located within a socket in the boot and when the boss is kicked along the ground surface, there are strong lateral forces tending to bend or break the stud about mid-way along its length. The rivet may be made of steel or of some other metal such as an aluminium alloy.

It will be observed that the stem 16 of the rivet 15 defines the bore of the axial hole 9 in the attachment portion and that the underside of the head 17 of the rivet defines an end face of the hub 8. Moreover, the tapered edge face of the head defines part of an inside face of the projecting end portion 14 of each buttress 13.

The presence of the rivet 15 also serves to limit the radial thickness of the spigot 3 and hub 8. This avoids the possibility of cavities forming in those parts during cooling and also reduces the cooling time required for the attachment portion.

When the attachment portion 1 has cooled it may have shrunk to an extent such that the rivet 15 becomes axially loose in the attachment portion. This may not matter as the rivet does not serve to secure components together. Nevertheless it might provide an opportunity for moisture or dirt to enter between the flared end portion 19 of the rivet and the flared end 9 of the hole in the attachment portion. To overcome any such problem the pin on which the rivet is located can be moved axially to a further small extent, before the mould is opened, thereby causing the shoulder on the pin to enlarge the flared end 19 slightly and press it against the moulding.

When the attachment portion has been moulded and any further movement of the pin has been completed, the third part of the mould is withdrawn in an axial direction and the first part of the mould is rotated through part of one turn so as to shift the moulding axially a short distance relative to the second part of the mould.

The boss 2 is then moulded on to the attachment portion 1 and the rivet 15. To this end a fourth mould part is substituted for the third mould part and plastics material for forming the boss is injected into the resulting cavity. The boss 2 is formed from a plastics material, such as polyurethane, that is rather more flexible and resilient than that from which the attachment portion is formed. An end portion 20 of the boss is of generally frusto-conical shape terminating in an end face which is flat or slightly domed. This end portion 20 abuts an annular end face of the collar 7. The boss embraces the buttresses 13, filling the gap between the collar 7 and the hub 8, the boss so becoming radially located within the collar. The boss seats against the head 17 of the rivet. The boss also includes anchorage portions which secure it mechanically to the attachment portion 1. The anchorage portions comprise fingers 21, which extend through the apertures 12 between the spokes 11, and a ring 22 at the ends of the fingers and which is moulded into the gap beyond the spokes, produced when the attachment portion was shifted axially on rotation of the first part of the mould. It will thus be seen that the attachment portion is held between the ring 22 and the end portion 20 of the boss 2, so that the boss and attachment portion are positively secured together.

After the boss 2 has been moulded and allowed to cool, the fourth mould part is withdrawn axially and the first mould part is rotated several times to eject the stud, the stud meanwhile being held against rotation. Multi-cavity tools may be provided to enable a plurality of studs to be formed at the same time.

When the stud is in use, any forces that are encountered tending to rotate the boss 2 relative to the attachment portion 1 are strongly resisted by the engagement between the boss and the sides of the buttresses 13 and the sides of the spokes 11.

In time it is likely that the end portion 20 of the boss will become progressively worn away. It is of course desirable that the stud be discarded and replaced with a new one before the wear becomes excessive. When the boss has been worn away to a certain extent the end portions 14 of the buttresses will start to become exposed. This can signal that the time has come to discard the stud. The material from which the boss 2 is formed is preferably of a colour quite different from that of the material from which the attachment portion 1 is made. This enables the exposure of the end portions 14 to become immediately visible. The shape and position of the end portions 14 can to some extent be varied in different models of stud so that they become visible after different degrees of wear.

Figure 4:
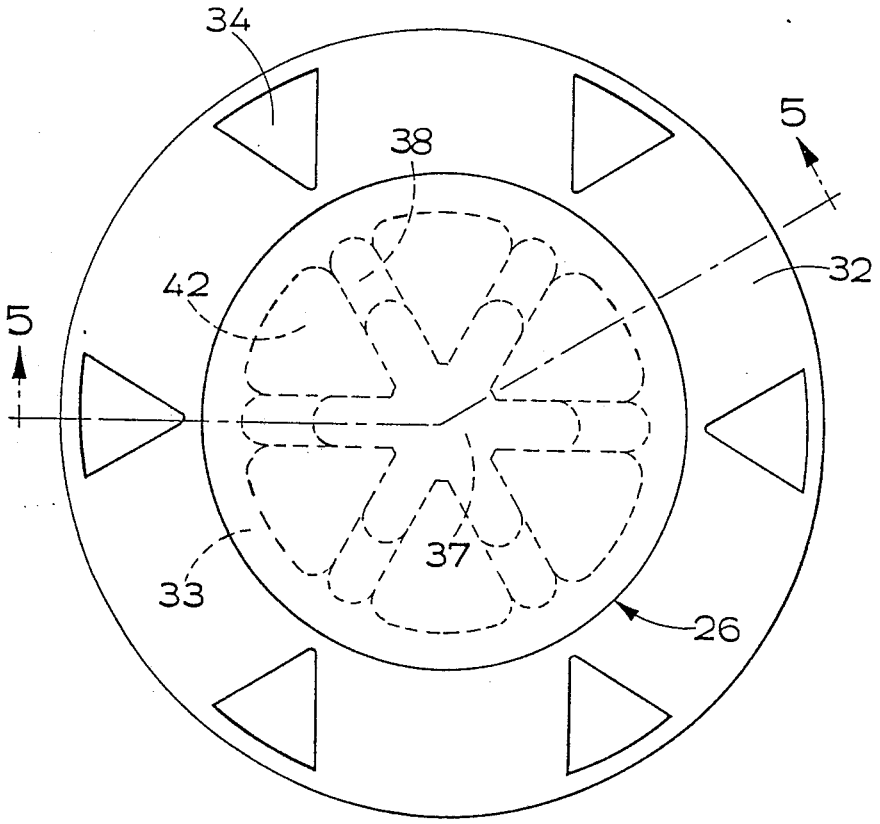
FIG. 4 is a plan view of a second stud embodying the invention.
Figure 5:
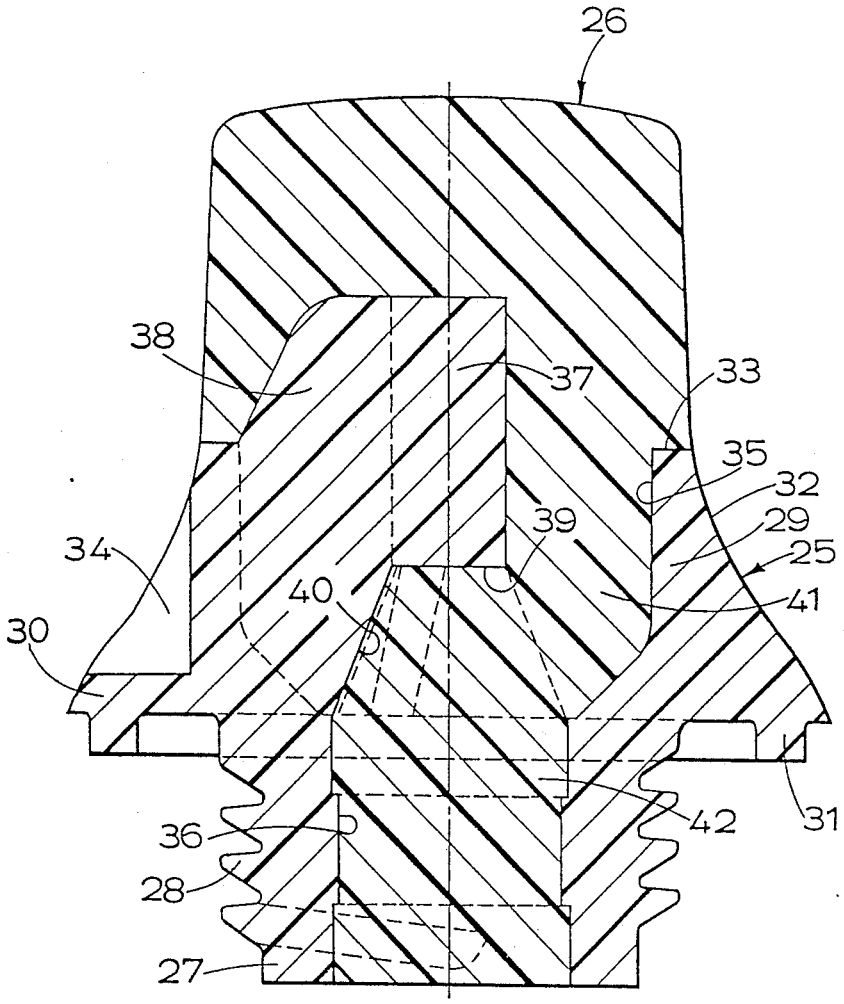
FIG. 5 is a sectional view of the second stud, taken along the line 5—5 of FIG. 4.

With reference to FIGS. 4 and 5, the second stud is of similar basic construction to the first and can be manufactured in a similar manner. It comprises an attachment portion 25 of an acetal resin, and a boss 26 of polyurethane moulded on to it. The attachment portion includes a spigot 27 formed with an external screwthread 28 of similar form to the thread 4 of the first stud. The remainder of the attachment portion 25 constitutes a body comprising portions providing a collar 29, a flange 30 and a retaining ring 31 in a generally similar arrangement to the first stud, the collar, flange and ring all being coaxial with the spigot 27.

The flange 30 extends radially outwards from the annular collar 29. The spigot 27 and the collar 29 project axially in opposite directions from the flange. An inclined outer surface 32 of the body extends down from a minimum diameter of the outer edge of a flat annular top end face 33 of the collar to a maximum diameter at the outer edge of the flange 30, as seen in FIG. 5.

The provision of six axially-aligned recesses 34, uniformly distributed around the body through the outer surface 32, forms external means of the body for engagement by a suitable stud-turning tool (of known form). As with the first stud, the body of the attachment portion being formed integrally with the spigot 27 results in a direct transmission of torque from the body to the spigot.

The inner surface 35 of the collar extends down from a maximum diameter at the inner edge of the annular collar end face 33 to a minimum diameter where it meets an inner end of an axial passage 36 extending right through the spigot 27. The inner surface 35 is cylindrical, or nearly cylindrical, for the major part of its axial length, and thereafter generally frusto-conical as it converges to the passage 36.

Within the collar 29 there is a central stiffening support, comprising an elongate cylindrical hub 37 which is axially aligned with the spigot 27. The hub 37 projects axially beyond the end face 33 of the collar in the direction away from the spigot. Six webs, lying in axial planes and forming radially extending spokes 38, join the hub 37 to the inner surface 35 of the collar 29, the spokes being uniformly distributed around the hub. The hub 37 is so mounted with its bottom end 39 axially spaced from the spigot and the bottom end of the collar. Bottom edges 40 of the webs extend between the hub end 39 and the bottom end of the inner surface 35 of the collar (at the inner end of passage 36) the hub being of lesser diameter than the inner end of the passage. Apertures so created between the spokes 38 open out at the bottom end of the spokes into a chamber constituted by the passage 36 and the space bounded by the bottom edges 40 of the spokes, the hub end 39 and the passage 36.

A top end portion of the hub 37, projecting axially beyond the collar 29, can serve as wear-indicating means in a similar manner to the end portions of the buttresses in the first stud.

In moulding the boss 26 on to the attachment portion 27, the boss-forming plastics material forms an outer end portion which surrounds the hub 37 and is seated on the collar end face 33. The material furthermore flows down between the spokes 38 to fill the chamber beneath the hub, including the passage 36 in the spigot. Attachment fingers 41 are so formed between the spokes, the fingers being joined up as a plug 42 beneath the hub. The attachment portion is thus held between the plug 42 and the outer end portion of the boss 26, so that the two parts of the stud moulding are positively secured together.

The relative proportions of the inside diameter of the collar 29, the diameter of the passage 36 through the spigot, the diameter of the hub 37, and the spacing of the hub from the passage 36, are chosen to ensure a good entry for the boss-forming material to flow through and form the plug 42.

I claim:

1. A method of making a stud for an article of footwear comprising a first moulding step of forming an attachment portion comprising an externally screw-threaded spigot for engagement with a complementary screw-threaded socket in securement of the stud to an article of footwear and a second moulding step of forming a ground-engaging boss moulded on to the attachment portion, the attachment portion being moulded of a relatively hard and inflexible plastics material and being formed to present means for engagement by a tool for assisting in screwing the stud spigot tightly into a socket and the boss being moulded of a material that is more flexible and resilient, the attachment portion being formed to comprise a collar bounding a chamber from within which a central stiffening support projects axially beyond the collar in the direction away from the spigot, the spigot being formed with an axially-extending passage which opens out into said chamber and the boss-forming material in the second moulding step being caused to envelop the central support and fill said chamber and form a plug within the passage in the spigot to interlock the boss moulding with the attachment portion.

2. A method according to claim 1 in which the boss becomes seated on an axially-facing end face of the collar.

3. A method according to claim 1 in which the stiffening support comprises a hub which is aligned axially with the spigot and is supported by means of spokes which extend radially outwards to the collar, apertures through which the boss-forming material flows being formed between the spokes.

4. A method according to claim 3 in which the spokes are in the form of webs lying in axial planes.

5. A method according to claim 3 in which at least the adjacent end of the hub is narrower than the passage through the spigot.

* * * * *